US006562412B1

(12) United States Patent
Fontaine

(10) Patent No.: US 6,562,412 B1
(45) Date of Patent: May 13, 2003

(54) METHOD AND APPARATUS FOR COATING STRIP SHAPED MATERIALS

(75) Inventor: Pascal Fontaine, Langenfeld (DE)

(73) Assignee: Fontaine Engineering und Maschinen, Langenfeld (DE)

( * ) Notice: Subject to any disclaimer, the term of this patent is extended or adjusted under 35 U.S.C. 154(b) by 0 days.

(21) Appl. No.: 09/337,110

(22) Filed: Jun. 21, 1999

(30) Foreign Application Priority Data

Apr. 28, 1999 (DE) ..... 199 19 234

(51) Int. Cl.[7] ..... B05D 1/18

(52) U.S. Cl. ..... 427/434.4; 118/424; 427/436

(58) Field of Search ..... 427/436, 432, 427/434.4, 433, 437, 438, 434.2, 348; 118/424, 117, 63, 64, 65, 423

(56) References Cited

U.S. PATENT DOCUMENTS

| | | | | |
|---|---|---|---|---|
| 2,095,718 | A | * | 10/1937 | Simmons |
| 2,317,533 | A | * | 4/1943 | Joslin |
| 2,873,720 | A | * | 2/1959 | Fugassi |
| 3,016,041 | A | * | 2/1962 | Oganowski et al. |
| 3,083,120 | A | * | 3/1963 | Paterson ..... 118/424 |
| 4,250,207 | A | * | 2/1981 | Tahahashi et al. |
| 4,519,337 | A | * | 5/1985 | Ono et al. |
| 6,117,237 | A | * | 9/2000 | Yarpel et al. |

FOREIGN PATENT DOCUMENTS

| | | |
|---|---|---|
| AU | 65284/65 | 4/1967 |
| AU | 65285/65 | 4/1967 |
| AU | 68087/65 | 6/1967 |
| AU | 9035/66 | 2/1968 |
| AU | 22026/67 | 11/1978 |
| JP | 75921 | of 0000 |
| JP | 5960/1951 | of 1951 |
| JP | 54393/1980 | of 1980 |
| JP | 96160/1980 | of 1980 |
| JP | 55085664 | 6/1980 |
| JP | 55128570 | 10/1980 |
| JP | 128570/1980 | 10/1980 |
| JP | 92370/1983 | 6/1983 |
| JP | 2752/1992 | 1/1992 |
| JP | 04-157142 A2 | 5/1992 |
| JP | 346211/1994 | 12/1994 |

* cited by examiner

*Primary Examiner*—Brenda A. Lamb
(74) *Attorney, Agent, or Firm*—Haynes and Boone, LLP

(57) ABSTRACT

A method and apparatus for coating a strip material with a coating material having the following elements: an oven; a bath with a coating material having an upper surface; a deflector roller, partially immersed in the coating material, which has a deflector bearing for facilitating rotation about its axis and the deflector bearing being arranged above the upper surface of the coating material; a first and second roller, each partially immersed in the coating material and each having a bearing, arranged above the upper surface of the coating material, for facilitating rotation of its respective roller about its axis; and a hood arranged above the rollers and having at least one nozzle for blowing a heated pressurized fluid onto the coated strip to ensure uniform coverage of the strip by the coating material.

5 Claims, 4 Drawing Sheets

METHOD AND APPARATUS FOR COATING STRIP SHAPED MATERIALS

This application claims priority under 35 USC §119 of German Application Number 19919234.0 filed on Apr. 28, 1999.

The invention relates to a method and apparatus for coating strip-shaped material with covering material, in which the strip-shaped material which is to be coated is guided into the coating bath, between two coating rolls, which are partly immersed in the coating bath, out of the coating bath and past stripping nozzles; the aforesaid components being collectively referred to as a coating plant.

BACKGROUND OF THE INVENTION

Coating plants for coating strip-shaped material have been known in diverse forms for a long time. The purpose of such a plant is to cover strip-shaped material of different types, i.e. metal strip, plastics material strip, fabric strip or paper strip, with different coverings of liquid media, e.g. with molten zinc, tin or alloys thereof or colouring material. The coating bath for coating the strip-shaped material with tin or zinc is in the form of a melted bath in which the materials are melted.

Coating plants of the type initially mentioned have been known for a long time, e.g. from JP-A 55128570. This coating plant is provided with a deflector roll which guides the strip through the bath and which is completely immersed with its bearings in the coating bath. Also provided are two coating rolls which are partly immersed in the coating bath and the bearings of which are likewise immersed in the latter. The strip-shaped material is guided around the deflector roll and then routed through the gap between the two coating rolls to the stripping nozzles. The deflector roll is arranged below the coating rolls in the coating bath in this coating plant such that the strip-shaped material passes upwardly through the gap between the two coating rolls. The strip is therefore firstly brought by means of the deflector roll into a position from which it passes from the bottom upwards through the gap between the two coating rolls.

As the bearings of the coating rolls and also of the deflector roll are immersed in the coating bath in this coating plant, they are subject to high wear levels on account not just of high friction- and flow-related stress, but also thermal stress, and have to be replaced frequently. However their replacement always entails bringing the complete line to a standstill and a considerable expenditure of time, as the rolls must be lifted out. This results in an interruption of the continuous operation and—following replacement—numerous working steps until the plant is returned to its working state.

Moreover, the strip which is to be coated cannot travel quickly without limitations in this known plant. An excessive amount of material is dragged out of the bath particularly at relatively high speeds, as the coating rolls are arranged at a certain distance from one another. A greater amount of material must accordingly be stripped off by means of the stripping nozzles.

In order to prevent splash phenomena in the case of coating baths where the strip is travelling at a fairly high speed, it is known from JP-A 55085664 to arrange the guide rolls, through which the strip which is to be coated travels on or under the surface of the coating bath, so that the distance between the surface of the coating bath and the contact point between the strip which is to be coated and a roll lies within the diameter of the roll. This known plant also provides regulation of the contact pressure force between the rolls and the intervening strip which is to be coated, with the possibility of uncurving the latter. However, in this known plant, in addition to the deflector roll, at least one guide roll is immersed in the coating bath such that its bearings are located in the latter. This arrangement therefore also entails the above-mentioned wear phenomena for the bearings with the necessity of replacing the corresponding rolls while shutting down the plant. In contrast, an object of the invention is to provide a coating plant of the type initially mentioned whose mobile parts have an extended life and to increase the speed of the strip which is to be coated.

BRIEF SUMMARY OF THE INVENTION

This object is solved by arranging the bearings of the coating rolls outside the coating bath.

With this type of structure of the coating plant, in which the bearings of the coating rolls lie outside of the coating bath, the bearings of these rolls are only subject to normal wear. Moreover, the rolls and their bearings can be accessed far more easily from outside, so that only a minimum amount of time is required to carry out a replacement if a bearing or a roll becomes defective. As the bearings of the coating rolls and therefore also their axles are located outside the coating bath, very little coating material is entrained out of the coating bath, as the space between the coating bath surface and the roll surface is firstly filled with coating material and only the adherent material is available for coating, without the presence of any further material above the rolls. The claimed coating plant enables higher strip speeds to be achieved. The coating material also exhibits no meniscus at the strip, as any coating material which is present in excess above the rolls is conveyed away from the strip by the rolls.

Advantages are obtained in particular when employing the galvannealing process on account of the short periods of immersion in the coating bath.

The rolls may be provided with a special coating in order to increase the service life of the coating rolls even when the bearings are mounted outside of the coating bath.

The maintenance costs will also be substantially lower than in the case of previous plant because of the above-mentioned advantages.

Advantageous developments are characterised by the subclaims.

Advantages are obtained with regard to the service life of the deflector roll bearings in a coating plant of the described type, in which the strip-shaped material is guided into the coating plant by means of one or more deflector rolls, if the bearings of one deflector roll or all deflector rolls are arranged outside of the coating bath. This arrangement of the deflector roll bearings enables the coating material container holding the coating bath to be substantially shallower than in the case of previous coating plant, in which one deflector roll is always located below the coating rolls in the coating bath.

This naturally applies to a plant structure which is without any deflector rolls for the strip-shaped material which is to be coated, with the latter being fed directly to the coating rolls and deflected by one of these.

Just one deflector roll may be provided, this being located outside of the coating bath. In this case this roll works with minimum friction losses. If the deflector roll is located outside of the coating bath or if no deflector roll is provided, the coating bath container may also be particularly small.

The coating rolls can advantageously be displaced horizontally and vertically, so that the plant can be adapted to different thicknesses of strip to be coated.

Differential coatings can be achieved if the coating rolls are adjusted in distance from the strip shaped material.

The stripping nozzles are preferably electrically heated. They can therefore easily be regulated. The use of a hood effectively prevents oxidation of the coating, especially in the case of metal coatings, due to a closed atmosphere, e.g. due to $N_2$. The viscosity of the coating can be maintained under a hood, so that, together with high stripping medium temperatures, excess coating material can be reliably stripped off. The speed of the strip which is to be coated can also be directly increased with high coating material viscosities. Temperatures of up to 600° C. may be employed for the hot stripping of metallic materials. This results in significant advantages in the galvannealing process.

Coating rolls of different diameters may be used, with greater roll diameters being selected for high speeds to prevent the coating medium from splashing due to centrifugal forces. Variable strip speeds of 30 to at least 300 metres per minute can be achieved.

Not only the coating rolls, but also the deflector roll if it is immersed in the coating bath, are preferably provided with strippers in order to strip off accumulating slag.

The strip-shaped material may be metal strip, plastics material strip, fabric strip or paper strip. Different coating baths with coating temperatures of appropriate settings are then used accordingly. The coating material used may be, e.g. zinc, aluminium, tin and alloys of a wide variety of types, and it is possible to use, for example, both liquids and colouring powder dissolved in water.

BRIEF DESCRIPTION OF THE DRAWINGS

Embodiments of the invention are described by way of example on the basis of the drawings, in which.

DESCRIPTION OF THE PREFERRED EMBODIMENT

Figure 1:
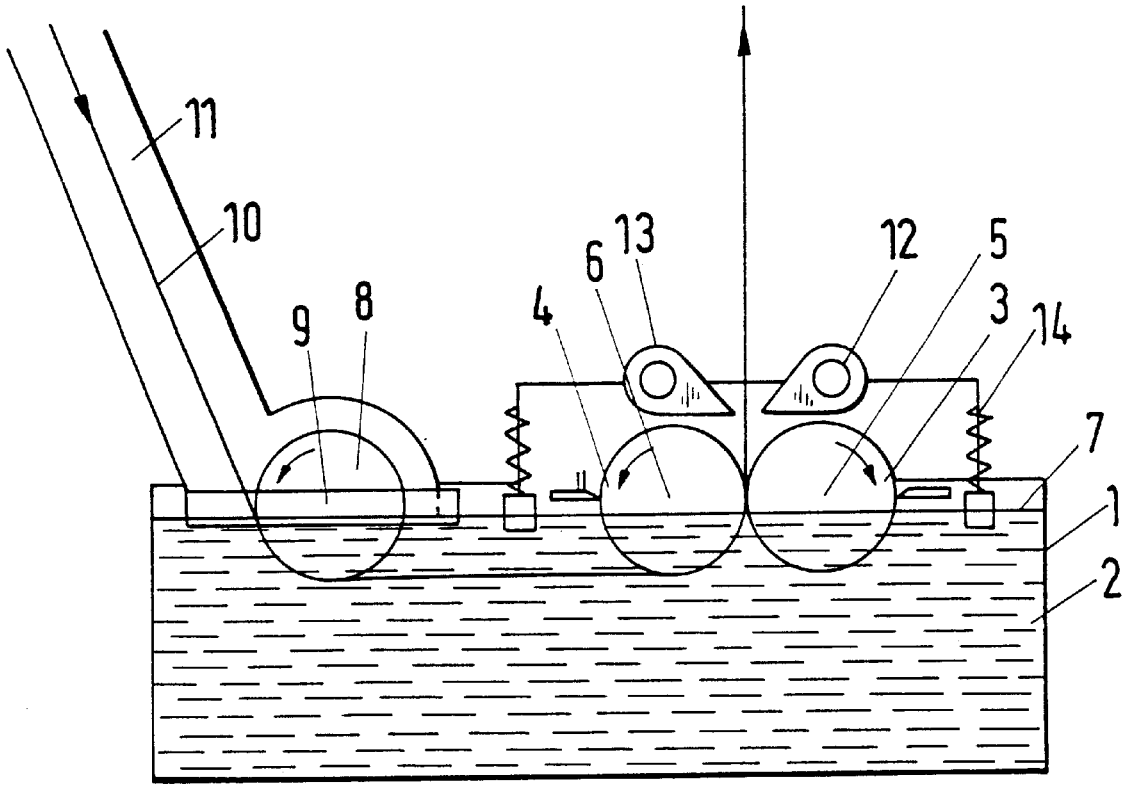
FIG. 1 is a section through a coating plant in which the bearings of the deflector roll and of the coating rolls lie above the coating bath, although the rolls are all partly immersed in the coating bath.

The coating plant according to FIG. 1 is firstly described in terms of its basic structure, with further details being given in connection with the description.

The coating plant comprises a coating material container 1, containing the coating bath 2 of coating material. The coating material may consist of molten tin, zinc, aluminium or alloys of a wide variety of types or of water-soluble colouring powder. In the represented embodiment according to FIG. 1 the coating material container 1 is a coating tank containing the coating bath 2.

A front coating roll 3 and a rear coating roll 4 are immersed in the coating bath such that the bearings 5 and 6, respectively, thereof are located above the top bath level 7 of the coating bath 2.

A deflector roll 8 is also immersed in the coating bath 2 in this embodiment. The bearings 9 of that roll are likewise located above the top bath level 7 of the coating bath 2.

The front and rear coating rolls 3 and 4 may or may not be driven. The coating rolls 3 and 4 are separated from one another by a small gap, so that the strip 10 which is to be coated passes through the gap so as to entrain the rear coating roll, which is not usually driven. Both the front and the rear coating rolls 3 and 4 are arranged so as to be both vertically and horizontally adjustable. The coating plant can thereby be set to different thicknesses of strip for coating in order to enable an optimum coating to be achieved.

The strip 10 which is to be coated is guided from a preheating oven 11 to the rear deflector roll 8, turned around this, conveyed to the rear coating roll 4, through the gap between the front and the rear coating roll 3 and 4, respectively, and out of the coating bath.

As already mentioned, the coating bath may consist of different liquids in order to provide the strip 10 with a covering. The bath may be at a temperature of up to 700 C.

During operation of a coating plant of this kind the strip 10 which is to be coated is preheated in a preheating oven 11, then immersed in the coating bath 2 and in the process turned around the deflector roll 8 in the direction of the rear coating roll 4, guided around this roll, through the gap between the two coating rolls 3 and 4 and out of the coating bath. The rear coating roll 4 may have a structured surface, for example, it may be profiled or rough in order to obtain an even coating on the strip which is to be coated on that side.

The two coating rolls 3 and 4 are arranged at an adjustable, minimum gap from one another. Irrespective of whether or not it is driven, the front coating roll 3 tends to introduce coating material into the hollow space between the bath surface and the strip and its circumferential surface and thus produce an even coating on the strip which is to be coated on this side of the latter. Both sides of the strip 10 which is to be coated carry excess coating material after emerging at the gap between the coating rolls 3 and 4. The amount of coating material 2 which is entrained is particularly small because the axes of the coating rolls 3 and 4 are located above the bath level 7 of the coating bath 2. The strip which is to be coated is covered by a thin layer of coating material on both sides and the consumption of coating material is extremely low.

In order to obtain a coating which is as even as possible, stripping nozzles 12 and 13 are provided above the coating rolls 3 and 4, respectively one on either side of the strip which is to be coated. However a plurality of stripping nozzles may be arranged one above the other on each side.

The parts of the coating rolls 3 and 4 which are arranged above the top bath level of the melting bath, as well as the stripping nozzles 12 and 13, are arranged in a hood 14 in this embodiment. The hood 14 enables the coating material to be stripped off under improved conditions. The hood 14 forms a space in which stripping can be carried out in a closed atmosphere, which prevents the coating material from forming a skin or slag. The closed atmosphere may be, e.g. a $N_2$ atmosphere or another gaseous atmosphere. The gaseous atmosphere, e.g. nitrogen or air, is delivered by the stripping nozzles. The gaseous atmosphere may preferably be preheated in the stripping nozzles. The stripping nozzles may be electrically heated, which provides the advantage of simple temperature regulation. The exit temperatures of the stripping gas may be up to 600° C. for so-called hot stripping. Both the front and rear coating rolls 3 and 4 have a relatively large diameter in order to prevent the coating medium from splashing due to centrifugal forces at relatively high strip speeds of, for example, 300 metres per minute. In order to remove slag or excess coating materials adhering to the coating rolls, strippers act on their outer circumferential surfaces.

The exit temperatures of the striping nozzles 12 and 13 is substantially higher than ambient temperature to achieve advantageous stripping. The two stripping nozzles 12 and 13 can be set to different blast strengths in order to enable the stripping to be varied if differences in the coating thickness are to be achieved.

Figure 2:
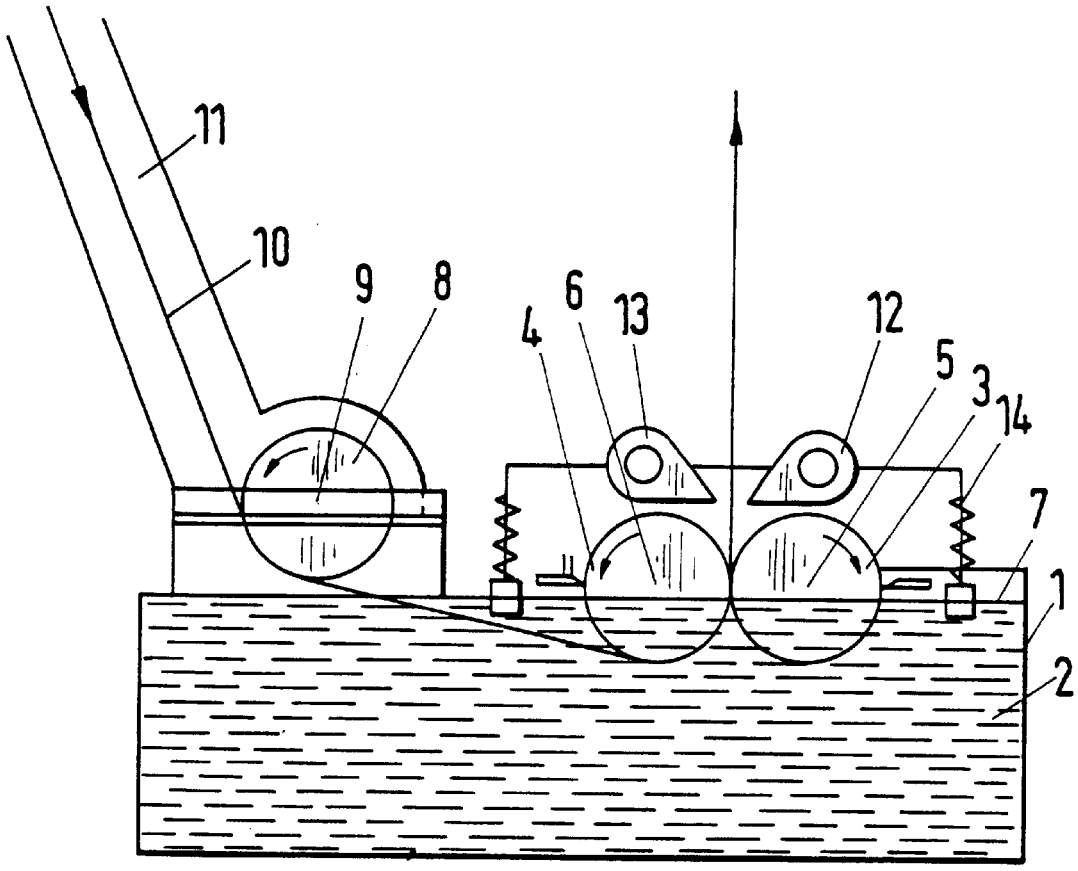
FIG. 2 is a section through a coating plant in which the deflector roll and its bearings are located entirely outside of the coating bath, while the coating rolls are partly immersed, with the bearings of these rolls lying above the coating bath.

FIG. 2 represents another embodiment of a coating plant in which the deflector roll 8 is mounted at the exit of the preheating oven 11 such that not only its bearings 9, but also the entire deflector roll is located outside of the melting bath 2. However the deflector roll 8 is also located at the end of the preheating oven 11 in this embodiment. The strip 10 which is to be coated travels around the deflector roll and is immersed in the coating bath 2 on its way to the rear coating roll 4. The coating operation is the same as in the embodiment according to FIG. 1, and stripping nozzles 12 and 13 are accordingly also provided in the embodiment according to FIG. 2.

The coating plant according to FIGS. 1 and 2 has a compact structure, as the coating material container 1 need not be very deep. The strip which is to be coated can be moved through the plant at high speeds.

The front and rear coating rolls are not only horizontally and vertically adjustable, but their central axes may also be staggered so as to permit differential coating.

Figure 3:
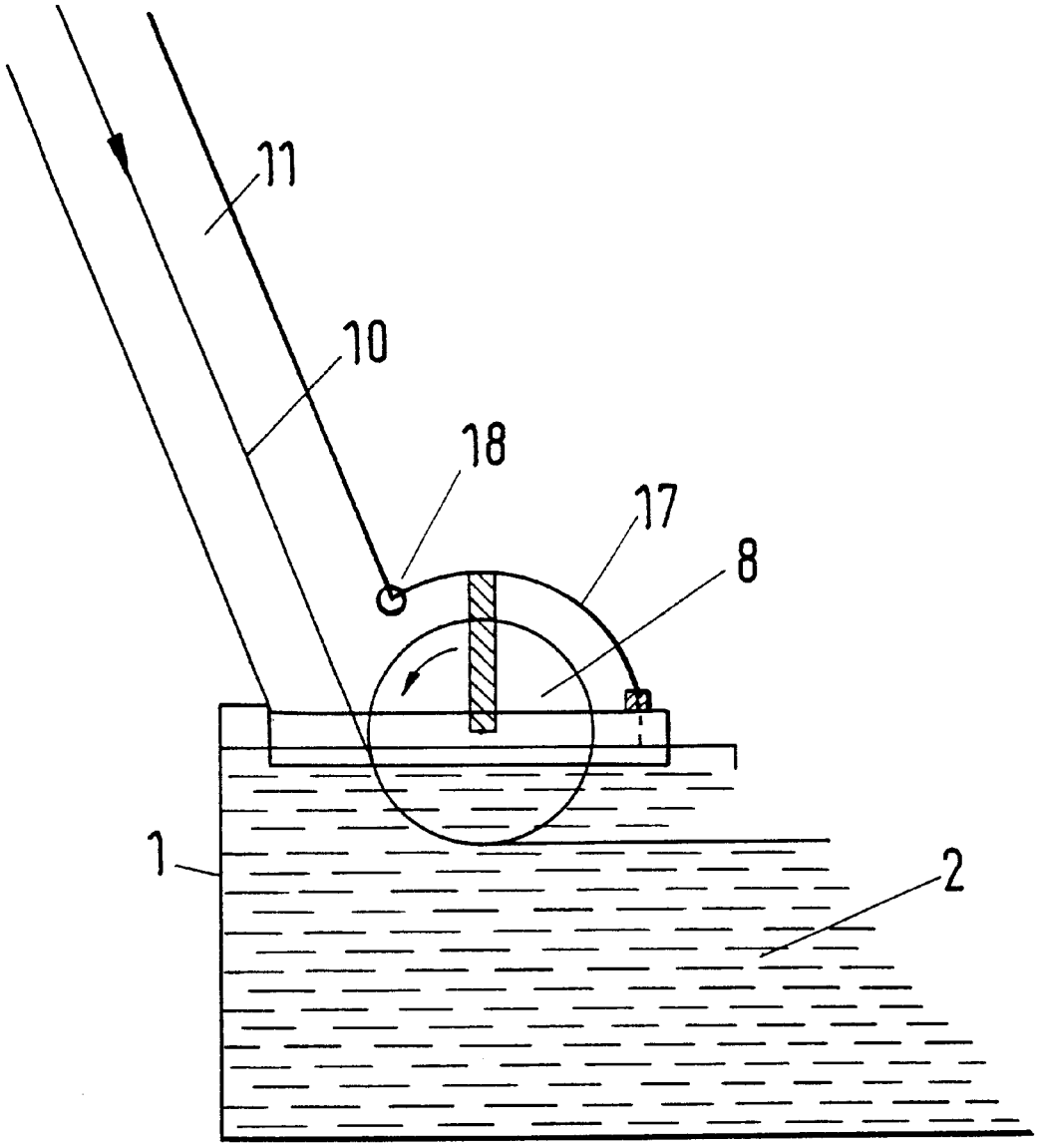
FIG. 3 is a section through an oven nozzle snout of the coating plant according to FIGS. 1 and 2 with the deflector roll mounted thereon.

FIG. 3 shows how the exit end of the preheating oven 11 may be formed so that this part of the plant can be easily serviced and repaired.

The deflector roll 8 is located under another hood 17, which is mounted at the end of the oven by means of a hinge 18. The hood 17 can be swung up if the deflector roll 8 is to be replaced or serviced.

Figure 4:
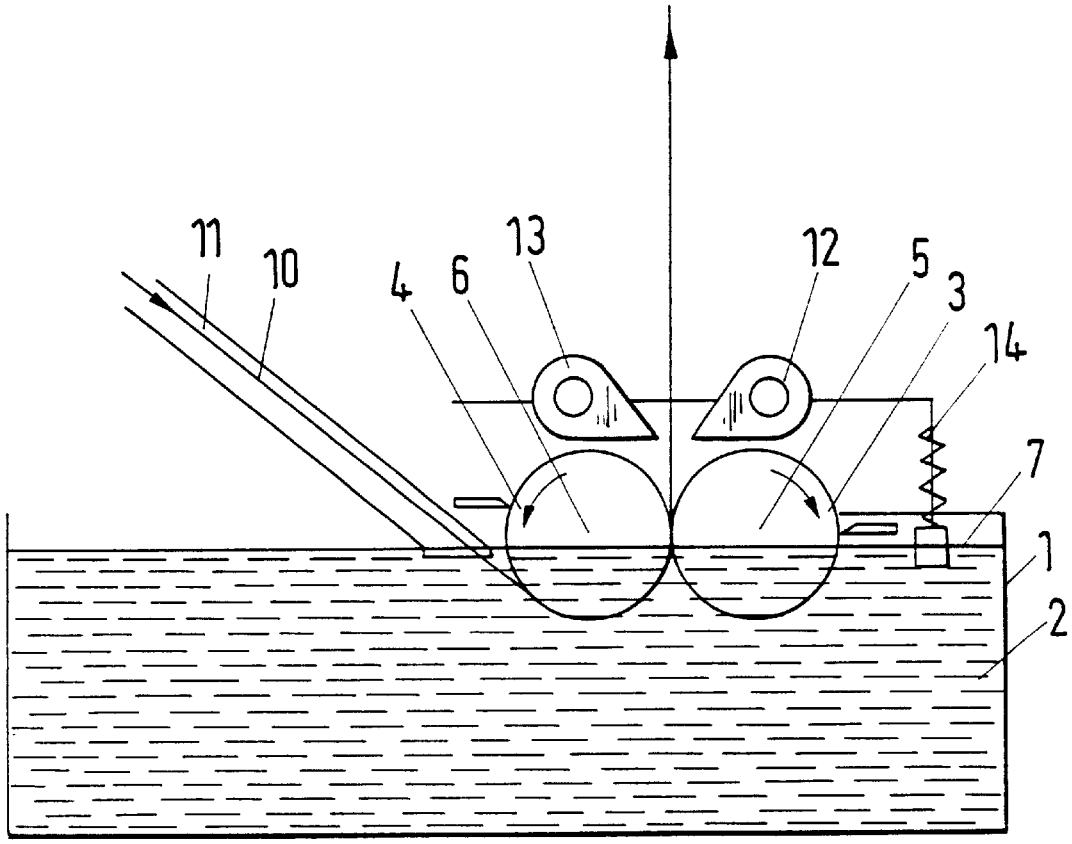
FIG. 4 is a section through a coating plant which has no deflector rolls and in which the strip-shaped material is guided directly around one of the coating rolls whilst passing between the rolls.

FIG. 4 shows a coating plant which has no deflector rolls and in which the strip which is to be coated is instead fed from the exit of the preheating oven 11 directly to the adjacent coating roll 4, guided around this and between the two coating rolls 3, 4. Only the coating rolls 3 and 4 are provided as rotating parts, so that the number of parts subject to wear is kept to a minimum.

Although the preferred embodiment as well as the operation and use have been specifically described in relation to the drawings, it should be understood that variations in the preferred embodiment could be achieved by a person skilled in the trade without departing from the spirit of the invention as claimed herein.

What is claimed is:

1. A coating plant for coating a strip material with a coating material, comprising:

an oven;

a bath located adjacent to the oven, wherein the bath contains a coating material having an upper surface;

a deflector roller partially immersed in the coating material disposed in the oven and including a deflector bearing to facilitate rotation about a deflector roller axis, the deflector bearing being situated above the upper surface of the coating material;

a first roller partially immersed in the coating material, such that less than half of the roller is immersed in the coating material, the first roller including a first bearing to facilitate rotation about a first axis, the first bearing being situated above the upper surface of the coating material;

a second roller partially immersed in the coating material, such that less than half of the roller is immersed in coating material, the second roller including a second bearing to facilitate rotation about a second axis, the second bearing being situated above the upper surface of the coating material, the second roller being disposed proximately and parallel to the first roller such that a gap is defined between the first and second rollers;

a hood disposed above the rollers; and at least one nozzle disposed within the hood for blowing a heated pressurized fluid;

wherein the strip material is guided through the oven, into the bath of coating material via the deflector roller, into the gap between the first and second rollers, into the hood, and past the at least one nozzle to ensure uniform coverage of the strip material by the coating material.

2. The coating plant of claim 1 wherein the oven has a hinged opening for accessing the deflector roller.

3. The coating plant of claim 1 wherein less than half of the deflector roller is immersed in the bath.

4. A method for coating a strip material with coating material comprising:

providing an oven;

providing a bath located adjacent to the oven, wherein the bath contains a coating material having an upper surface;

providing a deflector roller partially immersed in the coating material and disposed in the oven and including a deflector bearing to facilitate rotation about a deflector roller axis, the deflector bearing being situated above the upper surface of the coating material;

providing a first and a second roller including first and second bearings for respectively facilitating rotation about first and second axes;

immersing the deflector roller and the first and second rollers partially in the coating material, such that the deflector bearing and the first and second bearings are located above the upper surface of the coating material;

disposing a hood having at least one nozzle above the rollers;

guiding the strip material through the oven, into the bath, past the deflector roller into a gap between the rollers, into the hood, and past the at least one nozzle; and blowing a heated pressurized fluid from the nozzle to ensure uniform coating of the strip with coating material.

5. A coating plant for coating a strip material with a coating material, the strip material following a coating path through the coating plant, the coating plant comprising:

an oven;

a bath located adjacent to the oven, wherein the bath contains a coating material having an upper surface;

a deflector roller partially immersed in the coating material and disposed in the oven and including a deflector bearing to facilitate rotation about a deflector roller axis, the deflector bearing being situated above the upper surface of the coating material;

a first coating roller partially immersed in the coating material, such that less than half of the first coating roller is immersed in the coating material, the first coating roller including a first central bearing about which the first coating roller rotates;

a second coating roller partially immersed in the coating material, such that less than half of the second coating roller is immersed in the coating material, the second coating roller including a second central bearing about which the second coating roller rotates, the first and second central bearings being situated above the upper surface of the coating material, the second coating roller being disposed proximately and parallel to the first coating roller such that an adjustable minimum gap is defined between the first and second coating rollers so that a space between the upper surface of the coating material and the roller surface is firstly filled with the coating material when the strip material is guided into the first and second coating rollers and out of the bath;

a hood disposed above the first and second coating rollers; and at least one nozzle disposed within the hood for blowing a heated pressurized fluid on the coated strip material emerging from the gap between the first and second coating rollers;

wherein the strip material is guided through the oven, into the bath of coating material, past the deflection roller, into the gap between the rollers, into the hood, and past the at least one nozzle to ensure uniform coverage of the strip material by the coating material.

* * * * *

UNITED STATES PATENT AND TRADEMARK OFFICE

CERTIFICATE OF CORRECTION

PATENT NO. : 6,562,412 B1
DATED : May 13, 2003
INVENTOR(S) : Pascal Fontaine

It is certified that error appears in the above-identified patent and that said Letters Patent is hereby corrected as shown below:

Title page,
Item [73], Assignee, please delete "Fontaine Engineering und Maschinen, Langenfeld (DE)" and insert -- Fontaine Engineering Und Maschinen GmbH, Langenfeld (DE) --.

Signed and Sealed this

Twenty-third Day of March, 2004

JON W. DUDAS
*Acting Director of the United States Patent and Trademark Office*